US011036175B2

(12) United States Patent
Kase

(10) Patent No.: US 11,036,175 B2
(45) Date of Patent: Jun. 15, 2021

(54) IMAGE FORMING APPARATUS

(71) Applicant: CANON KABUSHIKI KAISHA, Tokyo (JP)

(72) Inventor: Shota Kase, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/705,779

(22) Filed: Dec. 6, 2019

(65) Prior Publication Data

US 2020/0192270 A1 Jun. 18, 2020

(30) Foreign Application Priority Data

Dec. 12, 2018 (JP) ..... JP2018-232434

(51) Int. Cl.
*G03G 21/16* (2006.01)
*G03G 21/18* (2006.01)

(52) U.S. Cl.
CPC ..... *G03G 21/1633* (2013.01); *G03G 21/1853* (2013.01)

(58) Field of Classification Search
CPC ..... G03G 21/1853; G03G 21/1633; G03G 21/1871; G03G 2221/166; G03G 2221/183
See application file for complete search history.

(56) References Cited

U.S. PATENT DOCUMENTS

2010/0226683 A1* 9/2010 Yamaguchi ..... G03G 21/1652 399/110
2011/0182614 A1* 7/2011 Onuma ..... G03G 21/1633 399/110
2014/0212151 A1* 7/2014 Oda ..... G03G 21/1652 399/12
2015/0010320 A1* 1/2015 Komatsu ..... G03G 21/1896 399/90

FOREIGN PATENT DOCUMENTS

JP 2005-214998 A 8/2005

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes a main assembly including an image forming portion capable of forming an image on a sheet, a rotatable cover movable between an open state and a closed state, a substrate mounting unit including a substrate mounting portion on which an electrical substrate is mounted, and a substrate cover portion engaged and held so as to cover the electrical substrate mounted on the substrate mounting portion. The substrate mounting unit includes a mounting and demounting mechanism configured to permit mounting and dismounting of the substrate cover portion. The substrate cover portion is covered by the cover when the cover is in the closed state, and the substrate cover portion is uncovered by the cover when the cover is in the open state.

11 Claims, 9 Drawing Sheets

IMAGE FORMING APPARATUS

FIELD OF THE INVENTION AND RELATED ART

The present invention relates to an image forming apparatus such as an electrophotographic copying machine, or an electrophotographic printing machine (laser beam printer, LED printer, or the like, for example).

In the field of image forming apparatus, there have been known those structured so that an electrical circuit board is disposed on the inward side of their external cover (Japanese Laid-open Patent Application No. 2005-214998). Structuring an image forming apparatus in this manner makes it possible to reduce the risk that a user accidentally touches the electrical circuit board in the image forming apparatus, thereby causing electrical problems.

Referring to FIG. 9, in the case of an image forming apparatus structured as described above, its electrical circuit board 101 is disposed on the inward side of the left cover 102, which is a part of the exterior shell of the image forming apparatus 104. The left cover 102 is held to the main assembly of the image forming apparatus 104 with a combination of claws 102, and holes 106*a* of the frame 106.

When it is necessary for a user or a service person to access the electrical circuit board 101, the claws 102*b* must be moved out of the holes 106*a* to remove the left cover 102 from the main assembly of the image forming apparatus 104.

However, the left cover 102 is required to cover a driving portion 107 in addition to the electrical circuit board 101. Therefore, the image forming apparatus 104 is structured so that it is difficult for a user to remove the left cover 102 from the main assembly of the image forming apparatus 104. Further, some image forming apparatuses are structured so that their left cover covers their low voltage power source circuit board and/or high voltage power source circuit board, making it difficult for the left cover 102 to be removed from their main assembly.

Moreover, from the standpoint of appearance, it is undesirable to provide the main assembly of the image forming apparatus 104 with holes or grooves, into which a tool (small driver or the like, for example) can be inserted to remove the left cover 102 from the main assembly. Conventionally, therefore, it has been a common practice to insert a tool into the main assembly through the gap between the end surface 102*a* of the left cover 102, and the frame 106, to move the claws 102*b* from the holes 106*a*. Thus, it has been possible for the end surface 102*a* of the left cover 102 to be scarred and/or dented by the tool.

The present invention was made in consideration of the situation described above. Thus, the primary object of the present invention is to provide an image forming apparatus which makes it easier to access its electrical circuit board on the inward side of its exterior cover, and also, to prevent its exterior cover from being damaged when its electrical circuit board is accessed.

SUMMARY OF THE INVENTION

In order to achieve the objects described above, the image forming apparatus in accordance with the present invention is provided with a main assembly having an image forming portion which is capable of forming an image on a sheet of recording medium, and an electrical circuit board holding portion which has: a rotationally movable cover which can be put in an open state in which the interior of the main assembly of the image forming apparatus is accessible, or a closed state in which the interior of the main assembly of the image forming apparatus is inaccessible, and a portion (i) in which an electrical circuit board is installed, (ii) a circuit board cover which is placed in a position in which it is held to cover the electrical circuit board in the abovementioned portion (i), the circuit board holding unit being provided with a mechanism for enabling the circuit board cover to be removably installable, wherein when the rotationally movable cover is remaining closed, the circuit board cover remains covered with a part of the rotationally movable cover, whereas when the rotationally movable cover is open, the circuit board cover remains exposed.

According to an aspect of the present invention, there is provided an image forming apparatus comprising a main assembly including an image forming portion capable of forming an image on a sheet; a rotatable openable cover movable between an open state in which an inside of said main assembly is capable of being accessed and a closed state in which the inside is not capable of being accessed; a substrate mounting unit including a substrate mounting portion on which an electrical substrate is mounted, and a substrate cover portion engaged and held so as to cover the electrical substrate mounted on said substrate mounting portion, wherein said substrate mounting unit includes a mounting and demounting mechanism configured to permit mounting and dismounting of said substrate cover portion, and wherein said substrate cover portion is covered by said openable cover when said openable cover is in the closed state, and said substrate cover portion is uncovered by said openable cover when said openable cover is in the open state.

Further features of the present invention will become apparent from the following description of exemplary embodiments with reference to the attached drawings.

Figure 3:
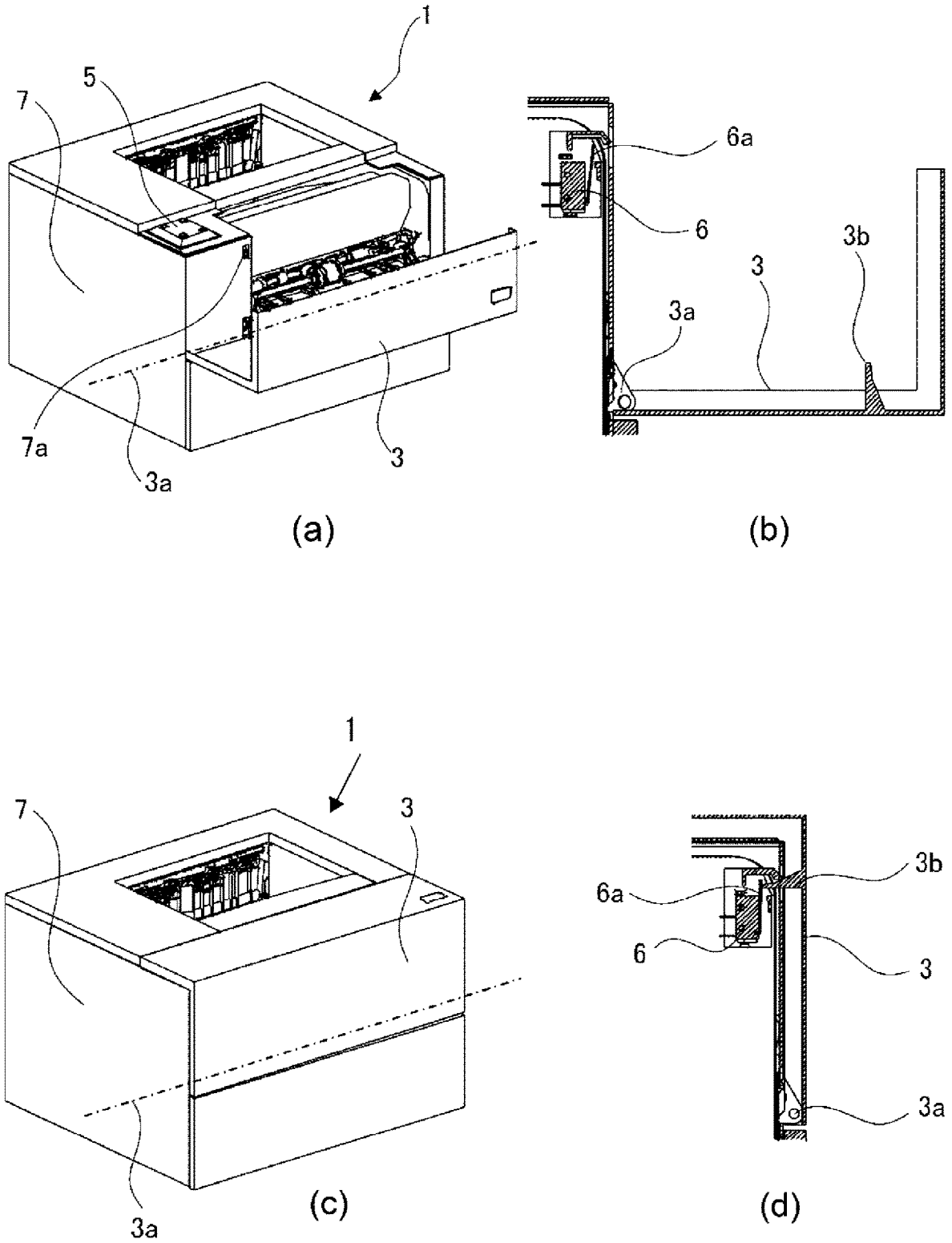

Parts (a), (b), (c) and (d) of FIG. 3 are a combination of a perspective view of the electrophotographic printer in the first embodiment, and a sectional view of a portion of the printer, which is related to the present invention, at a plane which is parallel to the side wall of the casing of the printer.

Figure 4:
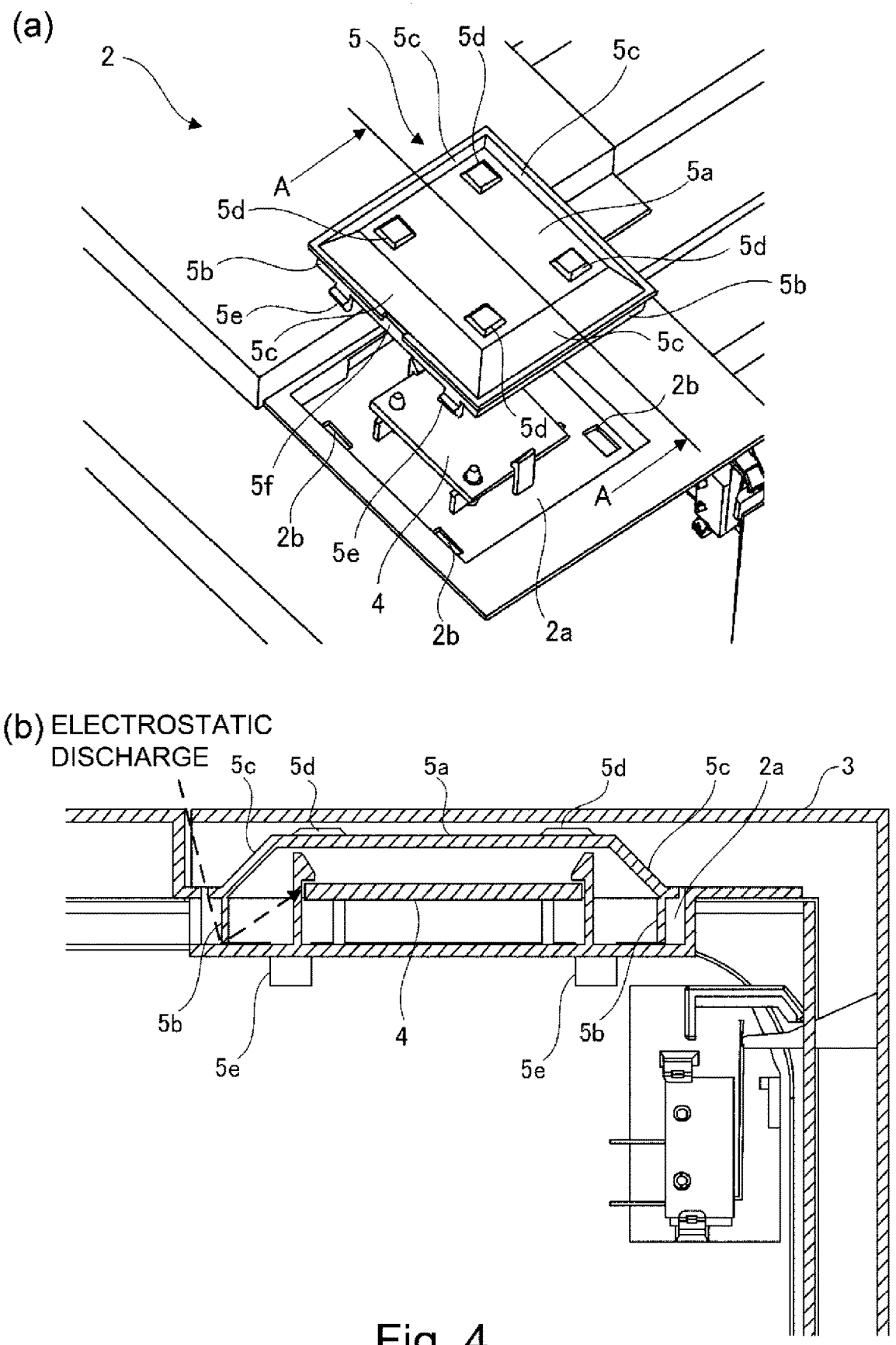

Parts (a) and (b) of FIG. 4 are a combination of an enlarged and exploded perspective view of the portion of the electrophotographic printer in the first embodiment, which is related to the present invention, and an enlarged sectional view of the same portion of the printer, at a plane which is parallel to the side panel of the printer.

Figure 5:
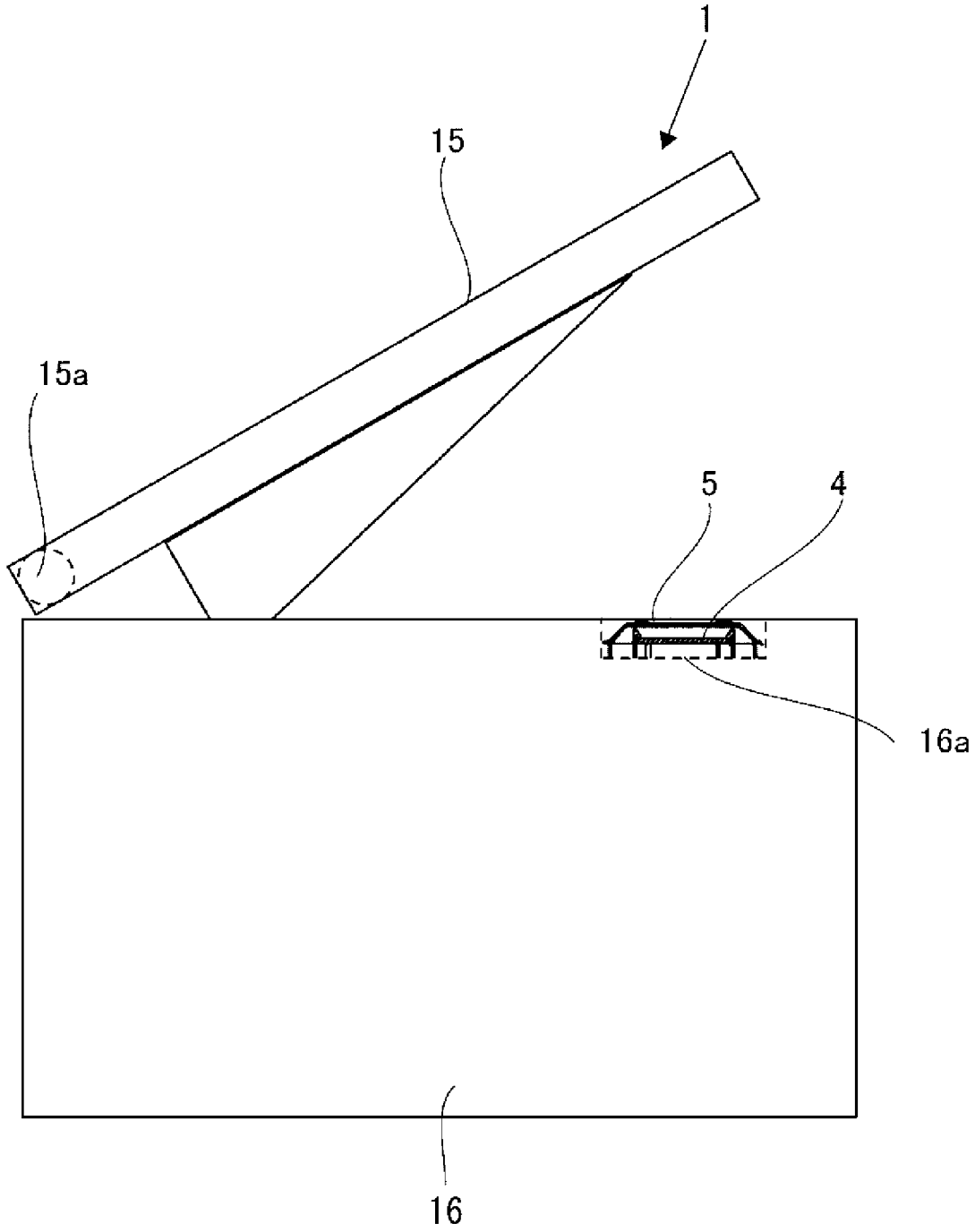

FIG. 5 is a drawing for describing the modified version of the printer in the first embodiment.

Figure 6:
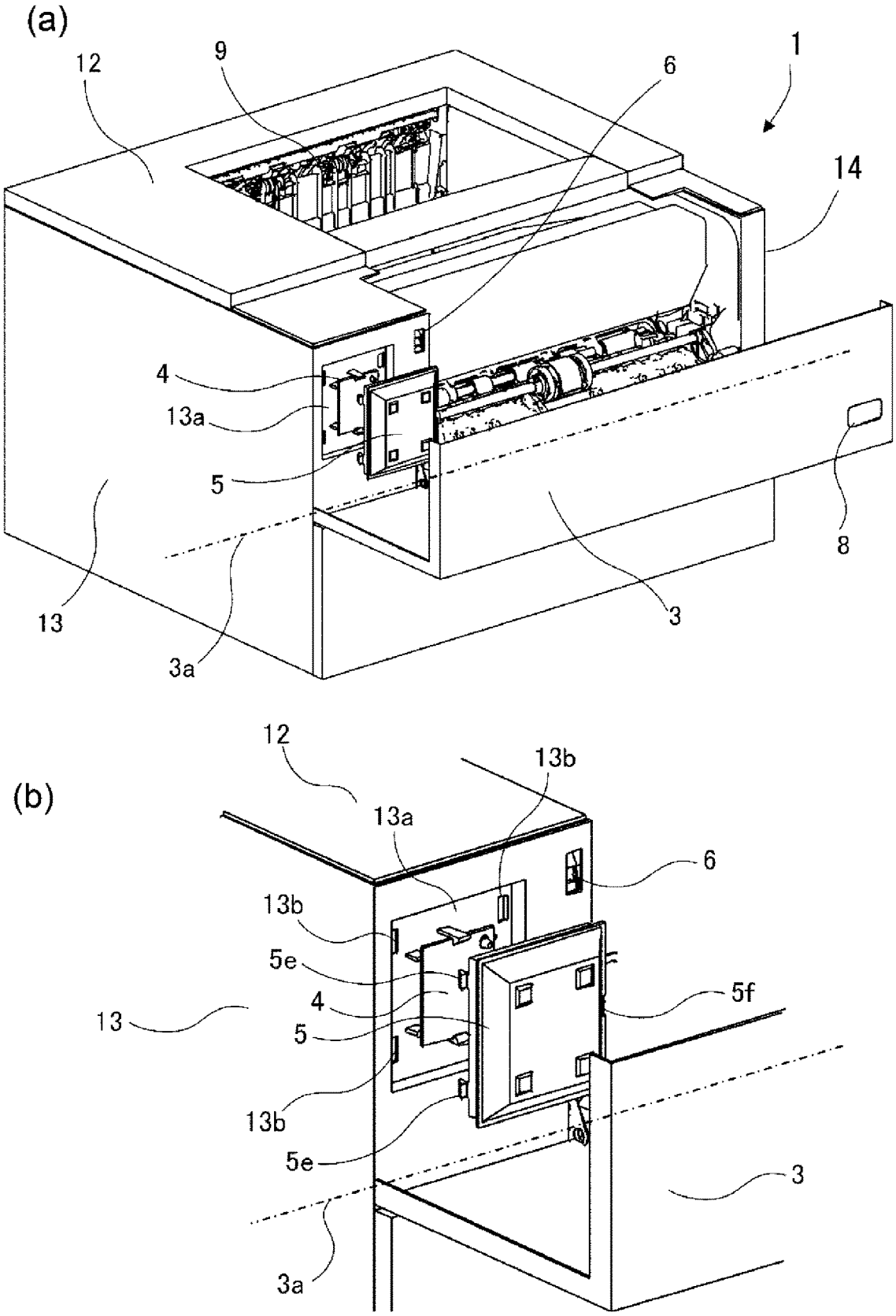

Parts (a) and (b) of FIG. 6 are a combination of a partially exploded perspective view of the electrophotographic printer in the second embodiment of the present invention, which is related to the present invention, and an enlarged and partially explode perspective view of the same portion of the printer.

Figure 7:
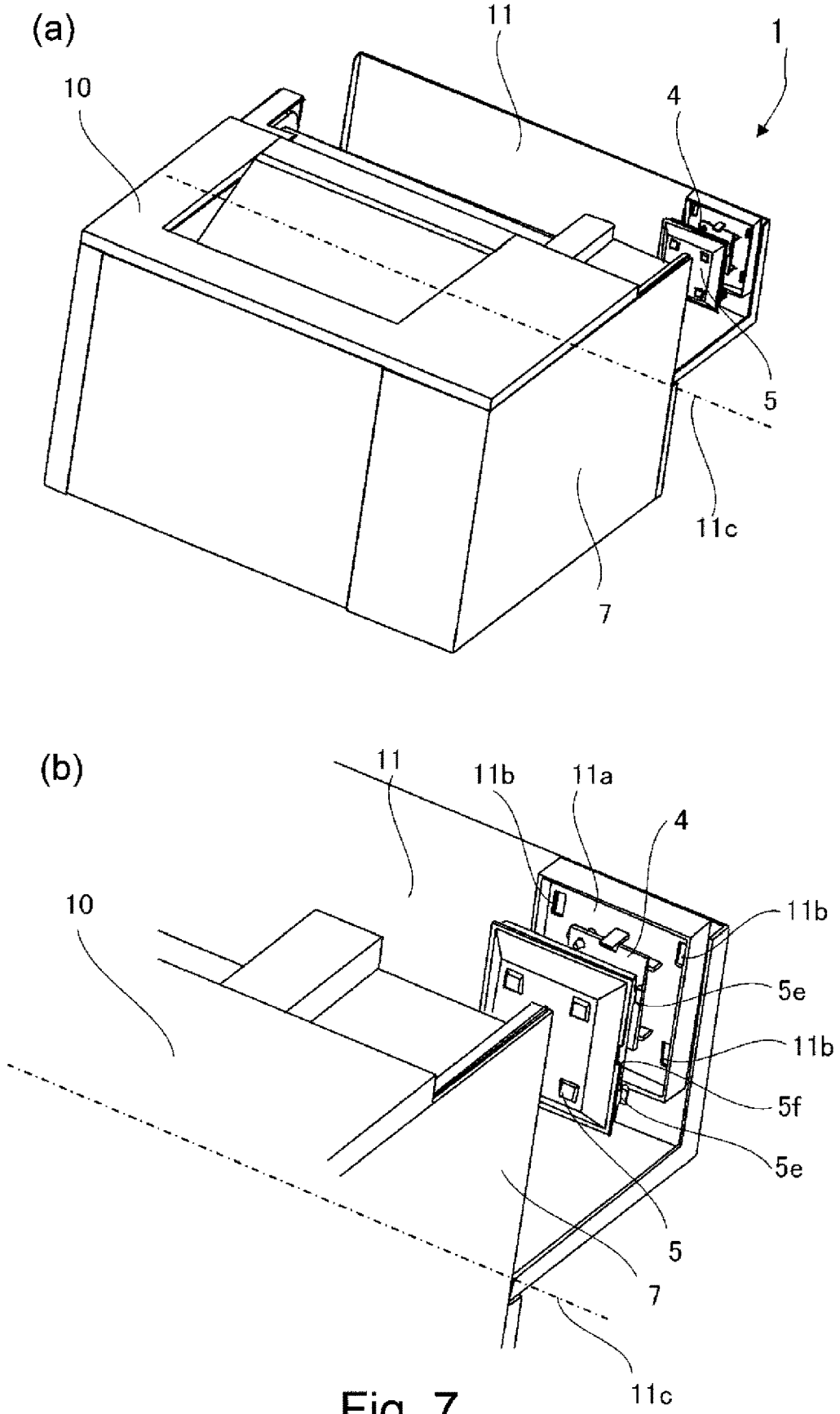

Parts (a) and (b) of FIG. 7 are a combination of a partially exploded perspective view of the electrophotographic printer in the third embodiment of the present invention, which is related to the present invention, and an enlarged and partially explode perspective view of the portion of the printer.

Figure 8:
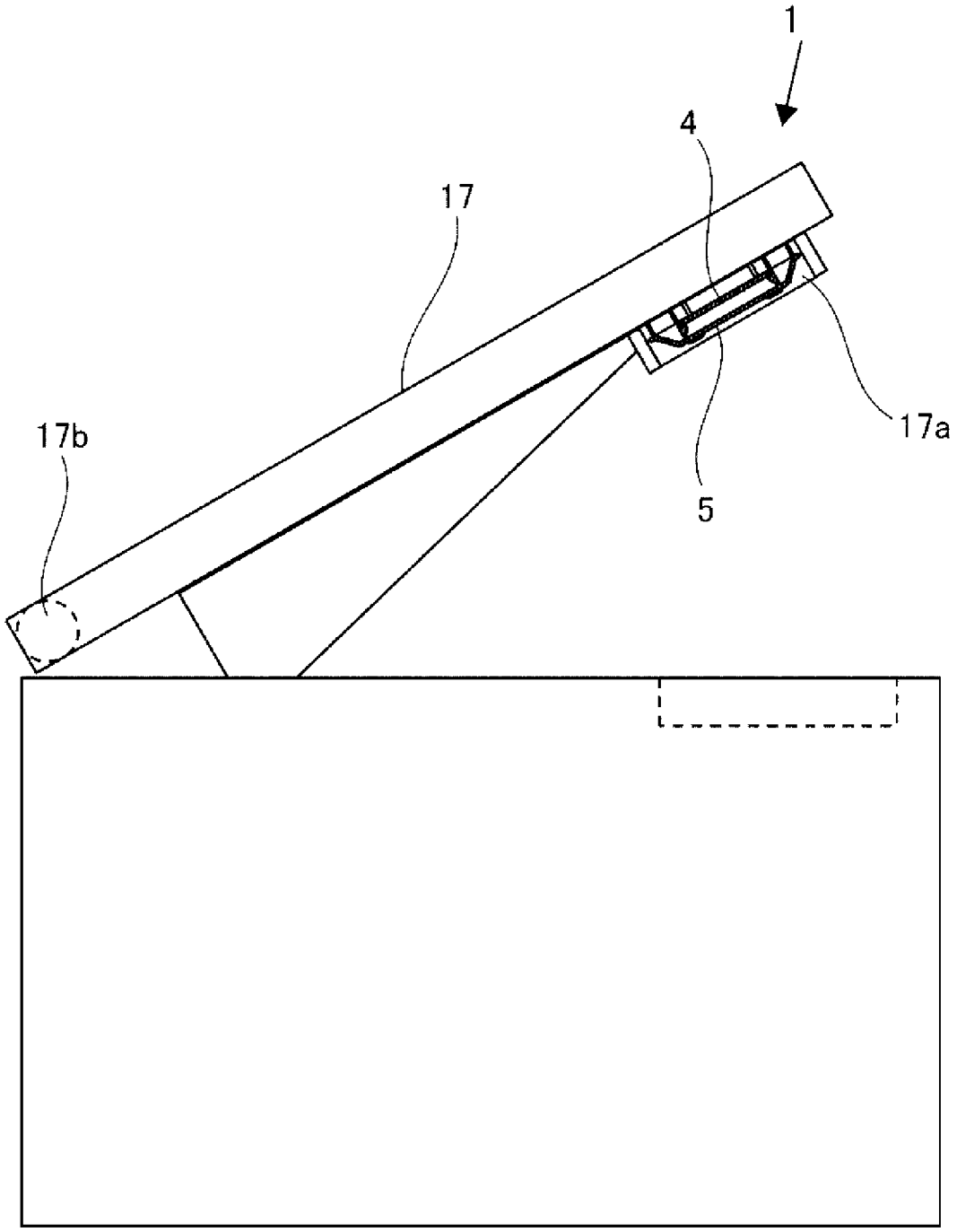

FIG. 8 is a drawing for describing the modified version of the printer in the third embodiment.

Figure 9:
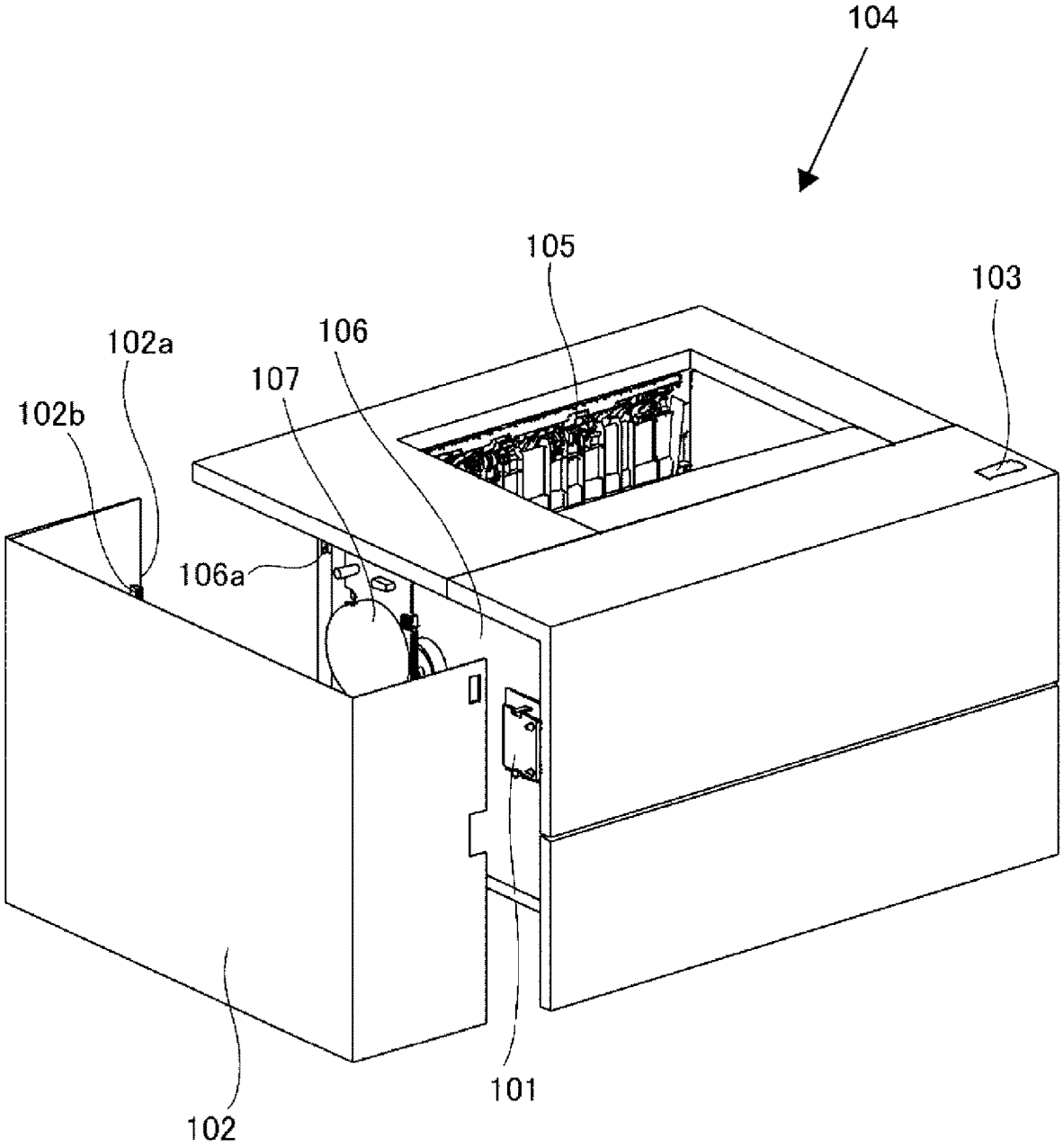

FIG. 9 is a drawing for describing the problems, from which conventional electrophotographic printers suffer.

DESCRIPTION OF THE EMBODIMENTS

Hereinafter, a few of preferred embodiments of the present invention are described with reference to the appended drawings. By the way, the structural elements disclosed in the following description of the preferred embodiments of the present invention are nothing but examples of structural components which are in accordance with the present invention. They are not intended to limit the present invention in scope. That is, the present invention is also compatible with electrophotographic printers which are different in structure from those in the following embodiments, as long as they are in accordance with the gist of the present invention.

Embodiment 1

Figure 1:
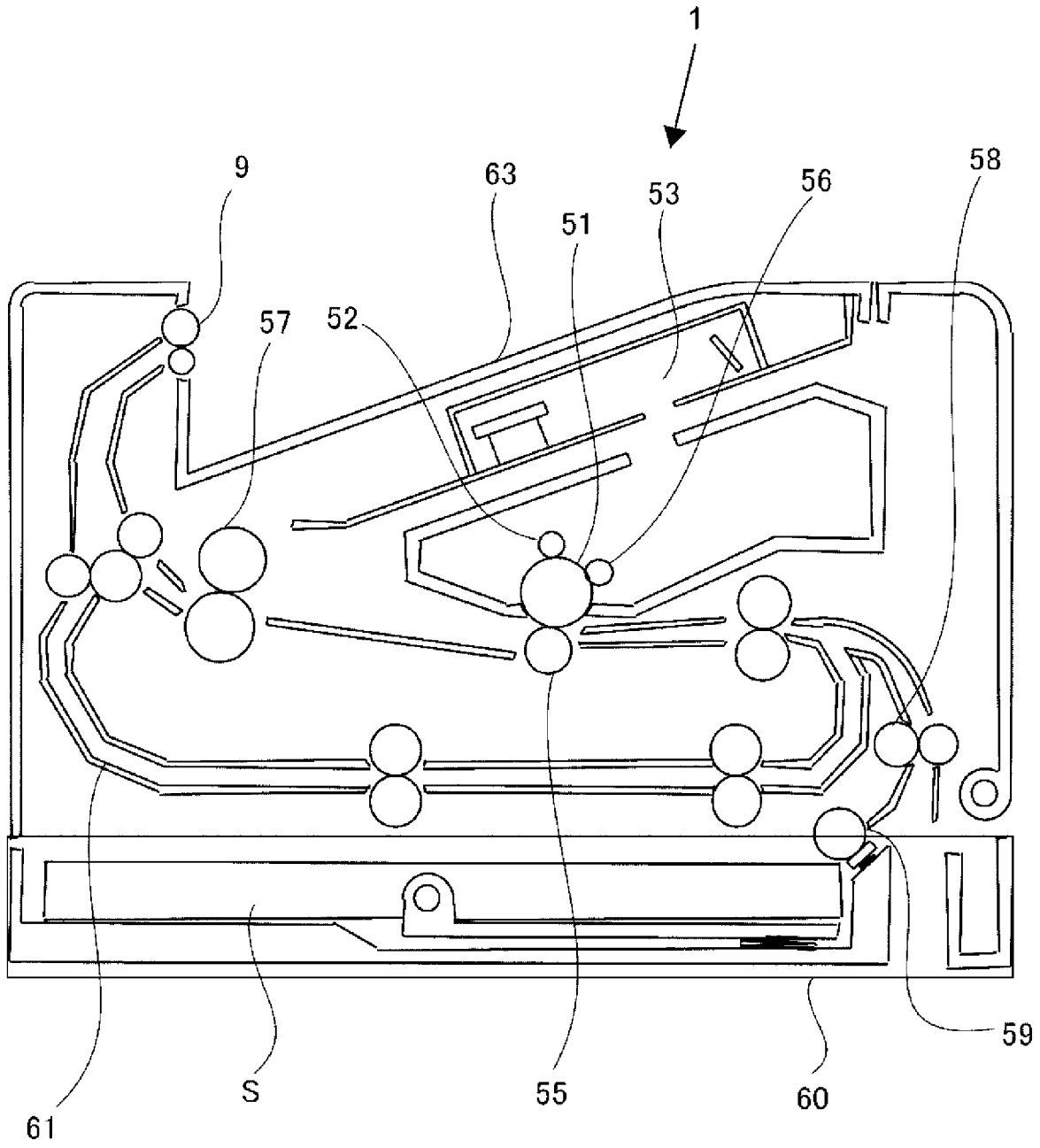
FIG. 1 is a schematic sectional view of the electrophotographic printer in the first embodiment of the present invention, at a plane which is parallel to the front wall of the casing of the printer.

FIG. 1 is a schematic sectional view of the electrophotographic printer, as an image forming apparatus, in the first embodiment of the present invention, at a plane which is parallel to the front wall of the casing of the printer. Referring to FIG. 1, a printer 1, which is an image forming apparatus, has: an image forming portion which transfers a toner image onto a sheet S of recording medium (printing paper or the like); a sheet conveying portion which delivers a sheet S to the image forming portion; and a fixing portion which fixes a toner image to the sheet S.

The image forming portion has a photosensitive drum 51, a charge roller 52, a laser scanner 53, a development sleeve 56, a transfer roller 55, etc.

The image forming process of this printer 1 is as follows: As an unshown controlling portion of the printer 1 receives an image formation job signal, one of the sheets S stored in layers in a sheet storage portion 60 is sent to the image forming portion by a combination of a feed roller 59 and a pair of sheet conveyance rollers 58.

Meanwhile, in the image forming portion, charge bias is applied to the charge roller 52, whereby the peripheral surface of the photosensitive drum 51, which is in contact with the charge roller 52, is charged. Further, the laser scanner 53 casts onto the peripheral surface of the photosensitive drum 51, a beam of laser light from its internal light source (unshown) while modulating the beam with the information of the image to be formed. Thus, the portions of the peripheral surface of the photosensitive drum 51, which were exposed to the beam of laser light, reduce in potential. Consequently, an electrostatic latent image, which is in accordance with the information of the image to be formed, is formed on the peripheral surface of the photosensitive drum 51.

Then, development bias is applied to the development sleeve 56, whereby toner is adhered to the electrostatic latent image on the peripheral surface of the photosensitive drum 51, from the development sleeve 56, forming thereby a toner image on the peripheral surface of the photosensitive drum 51. The toner image on the peripheral surface of the photosensitive drum 51 is moved into a transfer nip, which is the interface between the peripheral surface of the photosensitive drum 51, and that of the transfer roller 55.

As the toner image arrives at the transfer nip, transfer bias, which is opposite in polarity from toner, is applied to the transfer roller 55, whereby the toner image is transferred onto the sheet S, in the transfer nip.

After the transfer of the toner image onto the sheet S, the sheet S is sent to the fixing apparatus 57, by which the toner image is heated while being pressed on the sheet S. Consequently, the toner image becomes fixed to the sheet S. Then, the sheet S is discharged into a delivery tray 65 by a pair of reversal/discharge rollers 9.

By the way, in a case where the printer 1 is in the two-sided mode, in which an image is formed on both surfaces of the sheet S, the reversal/discharge rollers 9 are rotated in reverse, whereby the sheet S is conveyed to a two-side printing passage 61.

Figure 2:
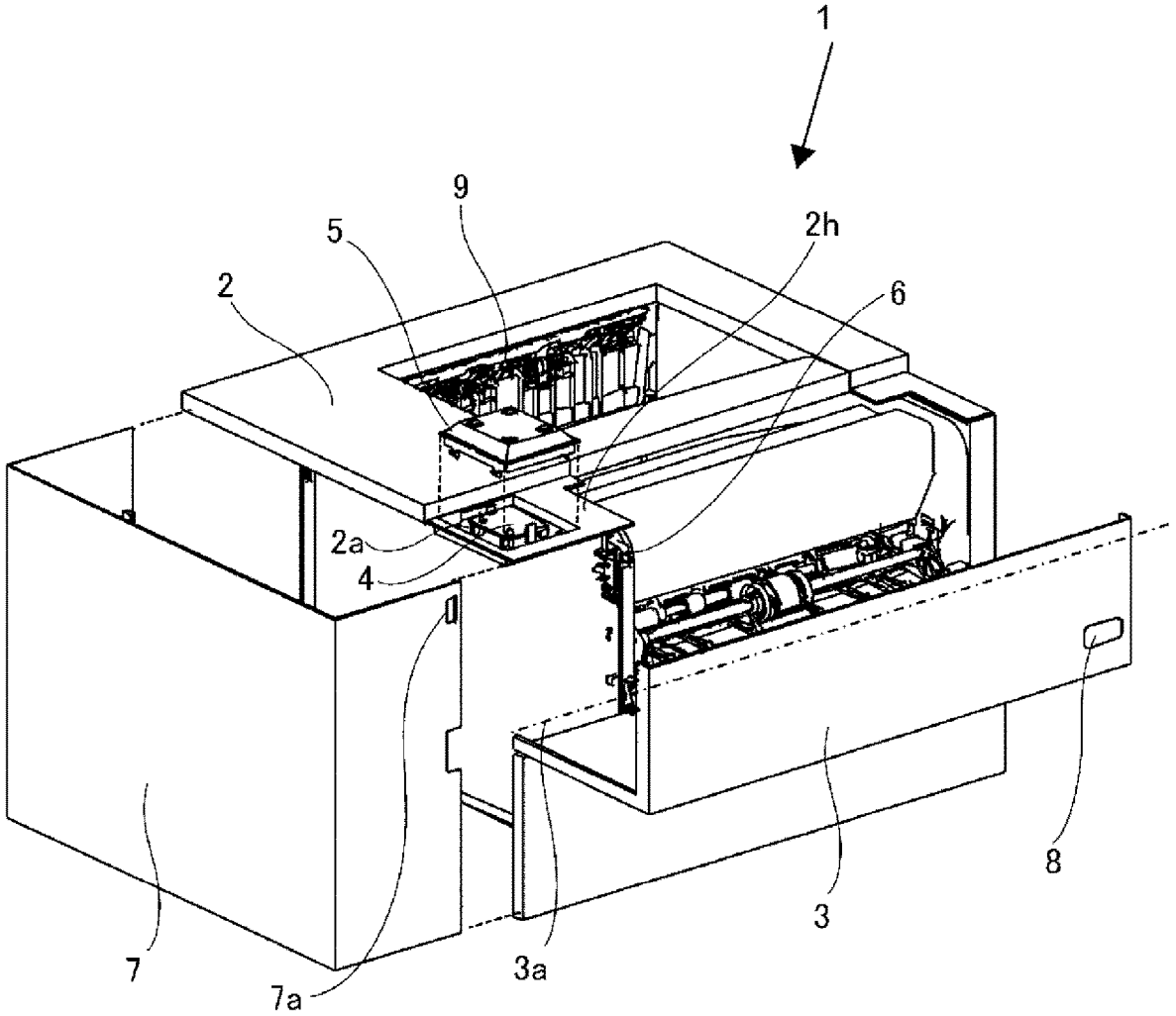
FIG. 2 is a partially exploded perspective view of the electrophotographic printer in the first embodiment.

FIG. 2 is a partially exploded perspective view of the printer 1 in FIG. 1. Referring to FIG. 2, the printer 1 has exterior covering members such as a top cover 2, which is a part of the casing of the printer 1 and is positioned to cover a part of the top portion of the main assembly of the printer 1, a left cover 7 which also is a part of the casing of the printer 1 and is positioned to cover the rearwardly facing portion of the main assembly, a part of the left side of the main assembly, a part of the right side of the main assembly, and a part of the front side of the main assembly. Further, the printer 1 has a rotationally movable cover 3, which also is a part of the casing of the apparatus main assembly. The cover 3 can be rotationally opened or closed to enable a user to access the interior of the printer 1. More concretely, the front cover 3 is rotationally movable about a rotational shaft (rotational axis 3*a*) which is at the bottom edge of the cover 3 and extends in the left-right direction (horizontally). That is, the printer 1 is structured so that its cover 3 can be put in a state in which the interior of the main assembly of the printer 1 is accessible, and a state in which the interior is not accessible. By the way, the exterior members mean the portions of the casing of the printer 1, which are visible from the outside of the printer 1 when the cover 3 is remaining closed.

The main assembly of the printer 1 is provided with an interlocking electrical switch 6, which is attached to the left-front portion of the main assembly. As for the left cover 7, which is a part of the frontal portion of the casing of the printer 1, it is provided with an opening 7*a*, which enables a protrusion 3*b*, which is on the back side of the cover 3, to act on the electrical switch 6 as the cover 3 is closed as shown in FIG. 3.

The top cover 2 has a lower portion 2*h*, which is the front portion of the top cover 2 and is slightly lower than the main section of the top cover 2. The left end portion of the lower portion 2*h* is provided with a rectangular recess 2*a*, which is roughly 65 mm in width, 65 mm in length, and 15 mm in depth. Thus, the bottom surface of the recess 2*a* is lower in position than the lower portion 2*h* in terms of the vertical direction of the printer 1. Further, the position of the recess 2*a* is higher than that of the electrical switch 6. It is in this recess 2*a* that a wireless communication board 4 (electrical circuit board) for the printer 1 to communicate with external devices is held.

The wireless communication board 4 is prevented from being unnecessarily accessed, by being surrounded by the walls of the recess 2*a*, and a circuit board cover 5 which is a part of a circuit board holding unit which covers the recess 2*a*.

The cover 3 is enabled to be opened or closed by being rotationally moved about the rotational axis 3*a*. Therefore, it is capable of covering a portion of the casing of the printer 1, as well as the lower portion 2*h* of the top cover 2, which includes the recess 2*a*, which the circuit board cover 5 covers. Further, the printer 1 is provided with an electric power source button 8 for turning on or off the printer 1, which is at the right end portion of the cover 3. Part (a) of FIG. 3 is a perspective view of the printer 1 shown in FIG. 1 when the cover 3 is open, and part (b) of FIG. 3 is a sectional view of the electrical switch 6 and its adjacencies, at a plane which is parallel to the side wall of the casing of the printer 1, when the cover 3 is open. Part (c) of FIG. 3 is a perspective view of the printer 1 shown in FIG. 1 when the cover 3 is remaining closed, and part (d) of FIG. 3 is a sectional view of the electrical switch 6 and its adjacencies, at a plane which is parallel to the side wall of the casing of the printer 1, when the cover 3 is remaining closed.

Referring to FIG. 3, the electrical switch 6 has a movable arm 6*a*. The electrical switch 6 functions as an interlocking switch which supplies the printer 1 with electric power or cuts off the power supply to the printer 1, as the movable arm 6*a* changes in position.

The cover 3 is provided with a projection 3*b*, which protrudes from its back surface, which corresponds in position to the front side of the printer 1. The projection 3*b* functions as an activator (de-activator) of the interlocking switch. More concretely, as the cover 3 is closed, the projection 3*b* enters the opening 7*a* of the left cover 7, and comes into contact with the movable arm 6*a* of the electrical switch 6, whereby the printer 1 is supplied with electric power (this action is referred to as "turning printer 1 on"); the interlocking is disengaged).

When the cover 3 is remaining closed, the circuit board cover 5 remains covered with the cover 3. Therefore, it is impossible for a user or a service person to access the wireless communication circuit board 4.

On the other hand, as the cover 3 is opened, the projection 3*b* of the cover 3 moves out of the opening 7*a* of the left cover 7. Therefore, the projection 3*b* does not contact the movable arm 6*a* of the electrical switch 6. Therefore, the power supply to the printer 1 is cut off (hereafter, this action is referred to as "turning printer 1 off"); the interlocking switch functions as a means to prevent the printer 1 from being supplied with electric power, even if the power supply button 8 is turned on.

When the cover 3 is open, the circuit board cover 5 remains exposed from the cover 3. Thus, it is possible for a user or a service person to access the wireless communication circuit board 4. Part (a) of FIG. 4 is an enlarged perspective view of the circuit board cover 5 and its adjacencies, and part (b) of FIG. 4 is a sectional view of the circuit board cover 5 and its adjacencies, at a plane A-A in part (a) of FIG. 4.

Referring to FIG. 4, the circuit board cover 5 has a top wall 5*a*, claws 5*e*, a claw accessing portion 5*f*, side walls 5*b*, slanted walls 5*c*, and protrusions 5*d*. The printer 1 is structured so that the circuit board cover 5 is removably attachable to the top cover 2. More concretely, as the claws 5*e* (engaging portions) fit, one for one, into the holes 2*b*, with which the bottom wall of the recess 2*a* of the top cover 2 is provided, the circuit board cover 5 is held to the top cover 2. That is, the circuit board cover 5 is held to the top cover 2 in such a manner that it covers the wireless communication board 4 in the recess 2a of the top cover 2. The claw accessing portion 5*f*, which is a disengaging portion, that is, a tool insertion portion, which is a part of the circuit board installation unit, is provided in the adjacencies of one of the slanted walls 5*c*. It is in the form of a groove. As a user or a service person inserts an unshown tool into the claw accessing portion 5*f*, the tool forces the claws 5*e* to come out of the corresponding holes 2*b*, enabling thereby the circuit board cover 5 to be removed from the top cover 2.

Further, the circuit board cover 5 covers the wireless communication board 4 with its top wall 5*a* which covers the top side of the wireless communication circuit board 4 when it is remaining attached to the top cover 2, slanted walls 5*c* which extend diagonally downward from the top wall 5*a* at an obtuse angle, and side walls 5*b* which extend roughly vertically downward from the slanted walls 5*c*.

In the case of an image forming apparatus, which is designed so that its wireless communication board 4 is to be replaced by a service person (board 4 is not to be replaced by a user), the provision of the slanted walls 5*c* makes it unlikely for a user to accidentally grasp the circuit board cover 5, reducing thereby the risk that a user might accidentally dislocate the circuit board cover 5 while the user is dealing with a paper jam or replacing cartridges. The side walls 5*b* function as bypasses (part (b) of FIG. 4) for preventing electrostatic discharge from reaching the wireless communication board 4, reducing thereby the electrical risk that the wireless communication board 4 might suffer from communicational failure.

Further, as the claws 5*e* are about to be forced to come out of the holes 2*b*, by such impacts that might occur during the shipment of the printer 1, the protrusions 5*d* which protrude upward from the top wall 5*a* prevents the claws 5*e* coming into contact with the top wall 5*a*, preventing thereby the claws 5*e* from coming out of the holes 2*b*. That is, the provision of the protrusions 5*d* reduces the risk that the circuit board cover 5 becomes disengaged.

The printer 1 is structured so that the wireless communication board 4 is placed in the recess 2*a* of the top cover 2, and is surrounded by the circuit board cover 5 as described above. Therefore, the printer 1 in this embodiment makes it easier to access the wireless communication board 4 than any conventional printer structured so that the electrical circuit board 101 is positioned on the inward side of the left cover 102 as shown in FIG. 9.

Further, this embodiment makes it unnecessary to remove a part of the casing (left cover 7, for example) when it is necessary to access the wireless communication board 4. Therefore, it is possible to prevent the problem that when the wireless communication board 4 is accessed, the external cover is scarred.

Moreover, as the cover 3 is opened to access the wireless communication board 4, the electrical switch 6 is automatically turned off. Therefore, even if a user or a service person accidentally presses the electrical power source button 8, the printer 1 does not operate. Therefore, it does not occur that a tool which was used to attach the wireless communication board 4, or for the like job, is pulled into the printer 1 by the rotation of the reversal/discharge rollers 9, and damages the printer 1.

Further, when the cover 3 is remaining closed, the wireless communication board 4 remains covered by both the circuit board cover 5 and cover 3, reducing thereby the electrical risk that the wireless communication board 4 is damaged by electrostatic discharge.

By the way, in this embodiment, the wireless communication board 4 is positioned on the left side of the center of the printer 1. However, the present invention is also compatible with a printer, the wireless communication board 4 of which is positioned on the right side of the center of the printer 1.

Further, in this embodiment, the printer 1 is structured so that its cover 3 is rotationally movable about the rotational axis 3*a* of the cover 3; and the wireless communication board 4 is placed in the recess 2*a* of the top cover 2, and is covered with the circuit board cover 5.

However, the present invention is also compatible with a printer having a top cover 15 which is rotationally opened or closed about its rotational axis 15*a* as shown in FIG. 5. In such a case, the printer 1 is structured so that the top wall of the main assembly of the printer 1, which is to be covered with the top wall 15, is provided with a recess 16, in which the wireless communication board 4 is placed and covered with the circuit board cover 5 as a circuit board cover. The printer 1 may be structured so that the wall to be covered with the top cover 15 is a part of the left cover 16, or a plastic member which is different from the top cover. Otherwise, the printer 1 in this embodiment is similar in structure to the printer 1 described above.

Embodiment 2

Next, the second embodiment of the present invention is described. By the way, in the following description of the printer 1 in this embodiment, the components of the printer 1, which are similar in structure as the counterparts in the printer 1 in the first embodiment are given the same referential codes as those given to the counterparts, and are not described.

part (a) of FIG. 6 is a partially exploded perspective view of the printer 1 in this embodiment. It shows the general structure of the printer 1. Part (b) of FIG. 6 is a partially exploded perspective view of the circuit board cover 5, and its adjacencies, of the printer 1 in this embodiment.

Referring to FIG. 6, the printer 1 in this embodiment is similar in structure to the printer 1 in the first embodiment, except that in this embodiment, what is the top cover 2 in the first embodiment is a top cover 12, and what was the left cover 7 is a left cover 13.

The cover 3 is rotationally movable about the rotational axis 3*a* to be opened or closed. That is, the printer 1 in this embodiment is structured so that when the cover 3 is remaining closed, the cover 3 keeps covered a part of the top wall of the casing of the printer 1, and the recess 2*a* covered with the circuit board cover 5, whereas as the cover 3 is opened, it retracts in a manner to make the interior of the main assembly of the printer 1 accessible to deal with a paper jam or cartridge replacement.

The left cover 13, which is one of the members of the casing, is a part of the wall for covering the front portion of the main assembly of the printer 1. It is provided with a recess 13*a*, which is a part of the circuit board holder unit, and in which the wireless communication board 4, with which the printer 1 is provided to allow the printer 1 to communicate with external devices. The wireless communication circuit board 4 is surrounded by the circuit board cover 5, which is a part of the circuit board holder unit, and the walls of the recess 13*a* of the left cover 13. Therefore, it is prevented from being accidentally accessed by a user.

When the cover 3 is remaining closed, the circuit board cover 5 remains covered by the part of the cover 3, which covers the front side of the main assembly of the printer 1. Therefore, when the cover 3 is remaining closed, a user or a service person cannot access the wireless communication board 4. On the other hand, when the cover 3 is open, the circuit board cover 5 remains exposed, allowing therefore a user or a service person to access the wireless communication circuit board 4.

The printer 1 is structured so that the circuit board cover 5 is removably attachable to the left cover 13. More concretely, the circuit board cover 5 is provided with claws 5*e*, which are fitted into holes 13*b*, with which the bottom wall of the recess 13*a* is provided. As the claws 5*e* are inserted into the holes 13*b*, the circuit board cover 5 is held in the recess 13*a* of the left cover 13. As for the removal of the circuit board cover 5, a user or a service person is to insert an unshown tool into a claw disengagement portion, which is a part of the circuit board holder unit, or a claw access portion 5*f*. As the tool is inserted, the claws 5*e* are released from the holes 13*b*, allowing the circuit board cover 5 to be removed from the left cover 13.

As described above, the printer 1 is structured so that the wireless communication board 4 is disposed in the recess 13*a* of the left cover 13, and is surrounded by the circuit board cover 5. Therefore, the printer 1 in this embodiment is easier in terms of the access to the wireless communication circuit board 4 than the printer 1 in the first embodiment, which is structured so that the electrical circuit board is disposed on the inward side of the left cover 103.

Further, the structural arrangement for the printer 1 in this embodiment makes it unnecessary to remove a part (left cover 13, for example) of the casing, in order to access the wireless communication circuit board 4. Therefore, this embodiment can prevent the casing from being damaged when the wireless communication circuit board 4 is accessed.

Moreover, as the cover 3 is opened to access the wireless communication circuit board 4, the electrical switch 6 is automatically turned off. Therefore, even if a user or a service person accidentally presses the power source button 8, the printer 1 does not operate. Therefore, it does not occur that the tool used for such an operation as attaching the wireless communication circuit board 4 is accidentally pulled into the printer 1 by the rotation of the reversal/discharge rollers 9. Therefore, it does not occur that the tool used for attaching the wireless communication circuit board 4 or the like operation damage the printer 1 by being pulled into the printer 1.

Further, when the cover 3 is remaining closed, the wireless communication circuit board 4 remains covered by the circuit board cover 5 and cover 3. Therefore, it is possible to reduce the electrical risk that the wireless communication circuit board 4 is damaged by electrostatic discharge, for example.

Further, in this embodiment, the wireless communication circuit board 4 is disposed in the front portion of the printer 1. Therefore, even in a case where an image scanner is mounted on the top over 12, and therefore, it is difficult to access the top side of the top cover, a user or a service person can easily access the wireless communication circuit board 4.

The portions of the printer 1 in this embodiment, which were not described, are the same in structure as the counterparts of the printer 1 in the first embodiment.

Embodiment 3

Next, the third embodiment of the present invention is described. By the way, the portions of the printer 1 in this embodiment, which are similar in structure to the counterparts of the printer 1 in the first embodiment, are given the same referential codes as those given to the counterparts, and are not described.

Part (a) of FIG. 7 is a partially exploded perspective view of the printer 1 in this embodiment. It shows the general structure of the printer 1. Part (b) of FIG. 7 is an enlarged perspective view of the circuit board cover 5, and its adjacencies, of the printer 1 in this embodiment.

Referring to FIG. 7, the printer 1 in this embodiment is similar in structure to the printer 1 in the first embodiment, except that the printer 1 in this embodiment has a cover 11 instead of the cover 3 in the first embodiment.

The cover 11 is opened or closed by being rotationally moved about its rotational axis 11*c*. Thus, when the cover 11 is remaining closed, it keeps covered a part of the casing of the printer 1, which corresponds in position to the top and front sides of the printer 1. As it is opened, it retracts in a manner to allow the interior of the main assembly of the printer 1 to be accessed for dealing with a paper jam, or replacing cartridges. More concretely, the portion of the cover 11, which covers the top-front portion of the main assembly of the printer 1, is provided with a recess 11*a*, which is a part of the circuit board holder unit. That is, the recess 11*a* is a circuit board holding portion which is a part of the circuit board holder unit. The wireless communication circuit board 4, with which the printer 1 is provided to enable the printer 1 to communicate with external devices is held in the recess 11*a*. The wireless communication circuit board 4 is surrounded by the circuit board cover 5, which is a part of the circuit board holder unit, and the walls of the recess 11*a* of the cover 11. Therefore, it is prevented from being accidentally accessed by a user.

The circuit board cover 5 is on the back side of the cover 3. Therefore, when the cover 3 is remaining closed, the circuit board cover 5 remains unexposed. Therefore, when the cover 3 is remaining closed, it is impossible for a user or a service person to access the wireless communication circuit board 4. On the other hand, when the cover 3 is open, the circuit board cover 5, which is on the back side of the circuit board cover 5, remains exposed, allowing therefore a user or a service person to access the wireless communication circuit board 4.

The printer 1 is structured so that the circuit board cover 5 is removably attachable to the cover 11. More concretely, as the claws 5*e* are fitted into the holes 11*b*, with which the bottom wall of the recess 11*a* of the cover 11 is provided, circuit board cover 5 is held to the cover 11. As for the removal of the circuit board cover 5, a user or a service person is to insert an unshown tool into the claw access portion 5*f* as a tool insertion hole. As the tool is inserted, the claws 5*e* are released from the holes 11*b*, allowing thereby the circuit board cover 5 to be removed from the cover 11.

According to this embodiment, the wireless communication circuit board 4 is held in the recess 11*a* of the cover 11, and is covered with the circuit board cover 5, as described above. Therefore, this embodiment makes it easier for the wireless communication circuit board 4 to be accessed than the first embodiment, in which the electrical circuit board 101 is disposed on the inward side of the left cover 102.

Further, this embodiment makes it unnecessary to remove a part (left cover 7, for example) of the casing of the printer 1 in order to access the wireless communication circuit board 4. Therefore, it can prevent the problem that when the wireless communication circuit board 4 is accessed, the casing of the printer 1 is damaged.

Further, as the cover 11 is opened to access the wireless communication circuit board 4, the electrical switch 6 is automatically turned off Therefore, even if a user or a service person accidentally press the electrical power source button 8, the printer does not operate. Therefore, it does not occur that the printer 1 is damaged by an accident that the tools used for attaching the wireless communication circuit board 4 are pulled into the printer 1 by the rotation of the reversal/discharge rollers 9.

Further, when the cover 11 is remaining closed, the wireless communication circuit board 4 remains covered by both the circuit board cover 5 and cover 11. Therefore, this embodiment can reduce the electrical risk that the wireless communication circuit board 4 is electrostatic discharge, for example.

Further, in this embodiment, no component is disposed between the wireless communication circuit board 4 and cover 11. Therefore, the printer 1 in this embodiment is superior to the printers 1 in the preceding embodiments in terms of the performance of the wireless communication circuit board 4 (it is greater in the distance electrical waves reach).

Moreover, in this embodiment, the printer 1 is structured so that the cover 11 can be opened or closed by being rotationally moved about its rotational axis 11*c*, and the wireless communication circuit board 4 is disposed in the recess 11*a* of cover 11 and is covered with the circuit board cover 5.

However, the present invention is also compatible with a printer structured so that its top cover 17 is enabled to rotate about its rotational axis 17*b* to be opened or closed. In such a case, the printer 1 is structured so that the top cover 17, which is a part of the casing of the printer 1, can be opened or closed; the portion of the top cover 17, which corresponds in position to the front portion of the main assembly of the printer 1, is provided with a recess 17*a*, as the circuit board holding portion, in which the wireless communication circuit board 4 is held. In this case, the recess 17*a* is covered with a circuit board cover 5, as the circuit board covering portion, which makes up a part of the circuit board holding unit. Otherwise, the printer 1 in this embodiment is similar in structure to those in the preceding embodiments described above.

By the way, in the preceding embodiments, it was the circuit board cover 5 that was provided with the claw access portion 5*f*. However, it may be walls of the recess that are provided with the claw access portion 5*f*.

Further, the claw access portion 5*f* does not need to be structured so that a tool can be inserted into the claw access portion 5*f*. For example, the claw access portion 5*f* may be in the form of a projection, which can be manipulated with a tool.

Further, in each of the preceding embodiments, the printer 1 was structured so that the circuit board cover 5 is removably attachable. However, it may be structured so that the circuit board cover 5 is permanently attached to one of the walls of the recess and is rotationally opened or closed.

Further, in each of the preceding embodiments, the printer 1 was structured so that the wireless communication circuit board 4 and circuit board cover 5 are held to the cover. However, the printer 1 may be structured so that the circuit board cover 5 is held to the frame of the main assembly of the printer 1.

Further, the present invention is compatible with a combination of two or more of the preceding embodiments. For example, the present invention is also compatible with a combination of the first and second embodiments.

Further, in each of the preceding embodiments, it was the wireless communication circuit board 4 that was placed in the recess. However, the present invention is also applicable to a printer structured so that a memory board, or a formatter board, that is, an electrical circuit board other than the wireless communication circuit board 4, is held in the recess.

While the present invention has been described with reference to exemplary embodiments, it is to be understood that the invention is not limited to the following claims and is to be accorded the broadest interpretation so as to encompass all such modifications and equivalent structures and functions.

This application claims the benefit of Japanese Patent Application No. 2018-232434 filed on Dec. 12, 2018, which is hereby incorporated by reference herein in its entirety.

What is claimed is:

1. An image forming apparatus comprising:

a main assembly including an image forming portion capable of forming an image on a sheet, an electrical circuit board, and a circuit board mounting member on which the electrical circuit board is mounted; and a rotatable openable cover movable between an open state in which an inside of the main assembly is capable of being accessed and a closed state in which the inside is not capable of being accessed, wherein the main assembly comprises a circuit board cover portion, and the circuit board cover portion is detachably attached to the circuit board mounting member so as to cover the electrical circuit board mounted on the circuit board mounting member, and wherein the circuit board cover portion is covered by the openable cover when the openable cover is in the closed state, and the circuit board cover portion is uncovered by the openable cover when the openable cover is in the open state.

2. An image forming apparatus according to claim 1, wherein the circuit board mounting member is provided in an outer casing member constituting a part of the outer casing.

3. An image forming apparatus according to claim 2, wherein the openable cover constitutes the outer casing at a lateral side of the image forming apparatus.

4. An image forming apparatus according to claim 3, wherein the openable cover constitutes the outer casing at a top of the image forming apparatus.

5. An image forming apparatus according to claim 2, wherein the circuit board mounting member is provided in the outer casing member at an upper part of the main assembly.

6. An image forming apparatus according to claim 2, wherein the circuit board mounting member is provided in the outer casing member at a lateral side of the image forming apparatus.

7. An image forming apparatus according to claim 1, wherein one of the circuit board mounting member and the circuit board cover portion includes an engaging portion, and the other of the circuit board mounting member and the circuit board cover portion includes a portion-to-be-engaged, and wherein the circuit board cover portion or the circuit board mounting member includes a tool inserting portion configured so as to permit insertion of a tool for breaking engagement between the engaging portion and the portion-to-be-engaged.

8. An image forming apparatus according to claim 1, wherein the circuit board mounting member is provided with a recess accommodating the electrical circuit board, and the circuit board cover portion covers the recess.

9. An image forming apparatus according to claim 1, wherein the electrical circuit board is a wireless communication circuit board to be additionally installed.

10. An image forming apparatus according to claim 1, wherein the openable cover is provided with an operating portion actable on an inter-relating switch for blocking electric power supply to the image forming apparatus, when the openable cover is in the open state.

11. An image forming apparatus according to claim 1, wherein the openable cover enables mounting and dismounting of a cartridge when the openable cover in the open state.

* * * * *